US006889686B2

(12) United States Patent
Specht

(10) Patent No.: US 6,889,686 B2
(45) Date of Patent: May 10, 2005

(54) ONE SHOT HEAT EXCHANGER BURNER

(75) Inventor: Werner Specht, Hermitage, PA (US)

(73) Assignee: Thomas & Betts International, Inc., Sparks, NV (US)

( * ) Notice: Subject to any disclaimer, the term of this patent is extended or adjusted under 35 U.S.C. 154(b) by 0 days.

(21) Appl. No.: 10/299,479

(22) Filed: Nov. 19, 2002

(65) Prior Publication Data

US 2003/0101983 A1 Jun. 5, 2003

Related U.S. Application Data

(60) Provisional application No. 60/336,956, filed on Dec. 5, 2001.

(51) Int. Cl.[7] ..... F24H 3/02

(52) U.S. Cl. ..... 126/110 R; 126/99 R; 126/116 R; 431/354

(58) Field of Search ..... 126/110 R, 91 A, 126/99 R, 85 R, 116 R, 110 B, 90; 431/190, 350, 351, 354, 181, 182, 326, 328

(56) References Cited

U.S. PATENT DOCUMENTS

| | | | |
|---|---|---|---|
| 1,135,840 | A | 4/1915 | Oudeville |
| 1,372,724 | A | 3/1921 | Stine |
| 1,500,513 | A | 7/1924 | Merrill |
| 1,568,771 | A | 1/1926 | Roy |
| 1,604,783 | A | 10/1926 | Pickup |
| 1,641,350 | A | 9/1927 | Nieberding |
| 1,744,439 | A | 1/1930 | Bitgood |
| 1,789,226 | A | 1/1931 | Ensign et al. |
| 1,830,464 | A | 11/1931 | Guenther |
| 1,870,013 | A | 8/1932 | Keenan, Jr. |
| 1,910,020 | A | 5/1933 | Le Boutillier et al. |
| 1,995,934 | A | 3/1935 | Mangold |
| 2,210,069 | A | 8/1940 | Ensign |
| 2,242,176 | A | 5/1941 | Denise |

(Continued)

FOREIGN PATENT DOCUMENTS

| | | |
|---|---|---|
| DE | 4223513 | 1/1994 |
| WO | WO 00/73711 | 12/2000 |

*Primary Examiner*—James C. Yeung
(74) *Attorney, Agent, or Firm*—Hoffmann & Baron, LLP

(57) ABSTRACT

A single burner, heat exchanger combination for particular use in a hot air furnace, includes a plurality of spaced heat exchangers, each heat exchanger having an inlet port for receipt therein of combustion gases. A unitary burner for producing combustion gases includes a burner face defined by a plurality of spaced fins for passing therethrough a combustible gas. The inlet ports of each of the heat exchangers are disposed adjacent to and in fluid communication with the passages defined by the burner face fins. A hot air furnace comprising the single burner, heat exchanger combination also includes a blower adapted to blow air over the heat exchangers and an induction blower in fluid communication with the outlets of the heat exchanger adapted to draw the combustion gases through the heat exchangers and to discharge such combustion gases outwardly from the furnace. An igniter is disposed on a support frame around the burner face for igniting the combustible gas flowing through the burner face fins for flow of combustion gases through the heat exchangers.

6 Claims, 7 Drawing Sheets

U.S. PATENT DOCUMENTS

| | | | | | |
|---|---|---|---|---|---|
| 2,251,710 | A | | 8/1941 | Livar | |
| 2,333,602 | A | * | 11/1943 | Van Almelo | 126/110 R |
| 2,480,547 | A | | 8/1949 | Caracristi | |
| 2,525,350 | A | | 10/1950 | Hanson | |
| 2,607,405 | A | | 8/1952 | Weinandy | |
| 2,611,359 | A | * | 9/1952 | Scogin | 126/110 R |
| 2,815,069 | A | | 12/1957 | Garraway | |
| 3,040,805 | A | * | 6/1962 | Lambert | 431/329 |
| 3,047,056 | A | | 7/1962 | Flynn | |
| 3,057,400 | A | * | 10/1962 | Wagner | 431/258 |
| 3,411,716 | A | | 11/1968 | Stephan et al. | |
| 3,628,735 | A | | 12/1971 | Desty et al. | |
| 3,670,713 | A | * | 6/1972 | Abbott | 126/110 R |
| 3,944,142 | A | | 3/1976 | Welden et al. | |
| 4,050,632 | A | | 9/1977 | Wyse | |
| 4,087,050 | A | | 5/1978 | Tsuji et al. | |
| 4,253,403 | A | | 3/1981 | Vatsky | |
| 4,384,178 | A | | 5/1983 | Nagai et al. | |
| 4,467,780 | A | | 8/1984 | Ripka | |
| 4,553,925 | A | | 11/1985 | Bricmont | |
| 4,909,728 | A | | 3/1990 | Nakamoto et al. | |
| 4,945,890 | A | | 8/1990 | Ripka | |
| 5,060,722 | A | | 10/1991 | Zdenek et al. | |
| 5,094,224 | A | | 3/1992 | Diesch | |
| 5,437,263 | A | | 8/1995 | Ellingham et al. | |
| 5,448,986 | A | | 9/1995 | Christopher et al. | |
| 5,685,695 | A | | 11/1997 | Klement et al. | |
| 5,997,285 | A | * | 12/1999 | Carbone et al. | 431/354 |
| 6,027,336 | A | | 2/2000 | Nolte et al. | |
| 6,036,481 | A | | 3/2000 | Legutko et al. | |
| 6,062,848 | A | | 5/2000 | Lifshits | |
| 6,179,608 | B1 | | 1/2001 | Kraemer et al. | |
| 6,196,835 | B1 | | 3/2001 | Gutmark et al. | |

* cited by examiner

ONE SHOT HEAT EXCHANGER BURNER

CROSS-REFERENCE TO RELATED APPLICATION

This application claims priority to U.S. Provisional Patent Application No. 60/336,956 filed on Dec. 5, 2001.

FIELD OF THE INVENTION

The present invention relates generally to an improved heat exchanger burner and, more particularly, to a single burner used in combination with a plurality of heat exchangers.

BACKGROUND OF THE INVENTION

Gas fired hot air furnaces have long been used to heat spaces in both residential and commercial settings. Most conventional gas fired furnaces include a plurality of heat exchangers, spaced apart to allow air flow therebetween. The heat exchangers define an internal flow path for hot combustion gases supplied by burners. Heat transferred through the heat exchangers may be used to effect heating of a particular area.

A common arrangement for gas fired furnaces is to provide an individual burner associated with each heat exchanger. This arrangement is shown schematically in FIG. 1. A fuel gas mixture 10 is delivered through a manifold 12. The manifold has a plurality of outlets 14 corresponding with the number of heat exchangers 16 employed in the furnace. Interposed between the heat exchangers and the manifold outlets are a plurality of burners 18 provided in one-to-one correspondence to the number of heat exchangers. The burners may be of conventional construction of the type shown in U.S. Pat. No. 6,196,835 which is incorporated by reference herein for all purposes. Each burner includes a venturi device which provides for the proper mixture of air and fuel. The air and fuel is combined at one end of the burner 18 adjacent the manifold 12 and the air/fuel mixture is ignited adjacent the opposite end of the burner 18 at a burner face 18*a*. The hot combustion gases enter each heat exchanger and are caused to flow in a tortuous path within each heat exchanger.

The individual burner/heat exchanger arrangement is more particularly shown in U.S. Pat. No. 4,467,780 and is generally described herein with reference to FIG. 2. As shown in FIG. 2, the typical hot air furnace 20 has a sheet metal outer covering 22 which encases a series of five heat exchangers 24, blower 26, burners 28, one burner for each heat exchanger 24, and a pressure regulator 30. The gas/air mixture is injected by burner 18 into the open end of a heat exchanger 24. As a part of the injection process, additional air is drawn into the heat exchanger 24 so that the gas may be fully combusted within the heat exchanger 24. A header 32 is connected to the exhaust portion of each of the heat exchangers 24, header 22 also being connected to an induction draft fan 34 which creates a negative pressure through the heat exchangers 24 and a positive exhaust pressure to discharge the gases resulting from combustion through opening 36 to the discharge flue. Blower 26 receives cold room air from the area which is to be heated, forces that air over the heat exchanger surfaces in the direction indicated by arrow 38, the air then being collected and returned to the rooms to be heated.

It should be appreciated that the arrangement shown in FIG. 2 requires multiple burners to be provided so that each heat exchanger employs an associated burner. Use of multiple burners generally increases the cost of the furnace unit. Furthermore, as multiple burners must be individually ignited, a manifold must be used to bring the gas fuel to the burner. The manifold must employ specifically configured orifices at the openings 14 to provide the proper amount of gas to each burner. The manufacture and maintenance of this manifold device also increases the cost of manufacture and maintenance of the furnace. Furthermore, in certain situations there is a desire to switch between two types of fuel sources such as natural gas and propane. The manifold devices are specifically manufactured to handle one type of fuel source. Accordingly, a conversion from one fuel source to another may require the alteration or replacement of the burners. Furthermore, the efficient operation of the furnace depends largely on the proper burning of each burner. In a multiple burner situation, it is often difficult to detect improper operation of an individual burner. Improper operation of any individual burner may result in the creation of undesirable combustion products and/or reduce the operating life of the heat exchanger.

SUMMARY OF THE INVENTION

In accordance with the present invention, the foregoing disadvantages of the prior art are addressed. In accordance with one aspect of the invention, a single burner, heat exchanger combination for a fuel-fired furnace comprises a plurality of spaced heat exchangers, each heat exchanger having an inlet port for receipt therein of combustion gases. A unitary burner is provided for producing combustion gases, the burner having a burner face for passing therethrough a combustible gas. The inlet ports of each heat exchanger is disposed adjacent to and in fluid communication with the burner face, whereby combustion gases may flow from the burner into each of the inlet ports of the heat exchangers.

In accordance with a particular arrangement of the present invention, a hot air furnace comprises a furnace outer covering and a plurality of heat exchangers supported within the covering in spaced arrangement, each heat exchanger having an inlet port and an outlet. A unitary burner is provided for producing combustion gases, the burner having a burner face for passing therethrough a combustible gas, the burner being supported within the covering with the burner face being disposed adjacent to and in fluid communication with all of the heat exchanger inlet ports, whereby combustion gases may flow from the burner into each of the inlet ports of the heat exchangers. A blower adapted to blow air over the heat exchangers is provided. An induction blower is also provided in fluid communication with the outlets of the heat exchangers, the induction blower being adapted to draw the combustion gases through the heat exchangers and to discharge such combustion gases outwardly from the furnace outer covering.

DETAILED DESCRIPTION OF THE PREFERRED EMBODIMENT

Figure 1:
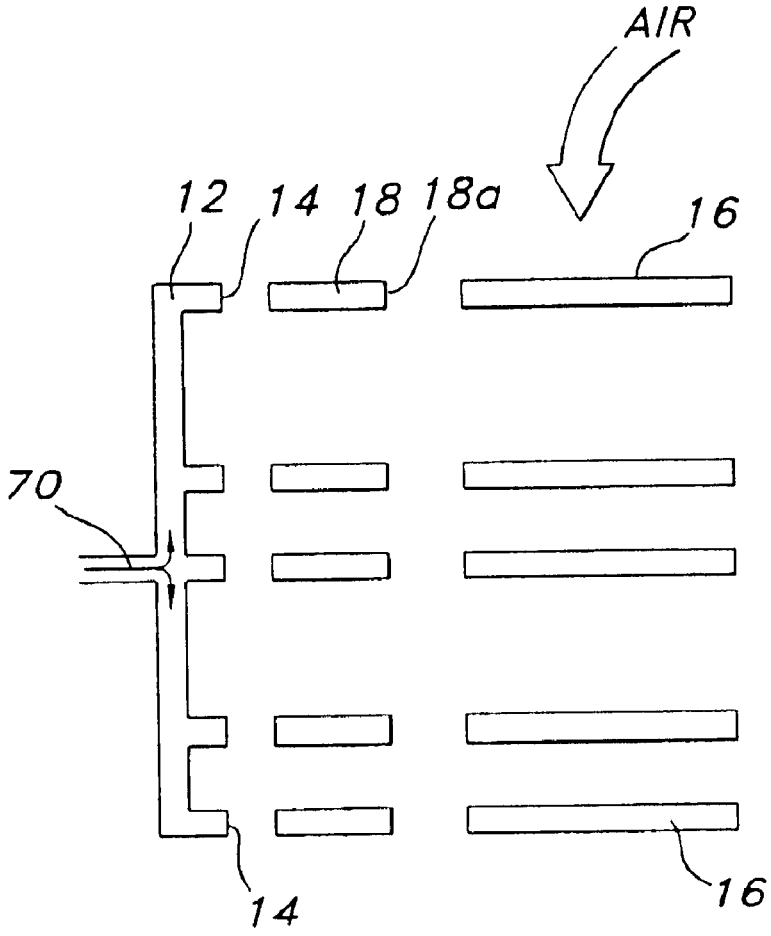
FIG. 1 (PRIOR ART)
FIG. 1 is a schematic representation of a prior art burner system for use with a plurality of heat exchangers in a hot air furnace, with one burner being associated correspondingly with each heat exchanger.
Figure 2:
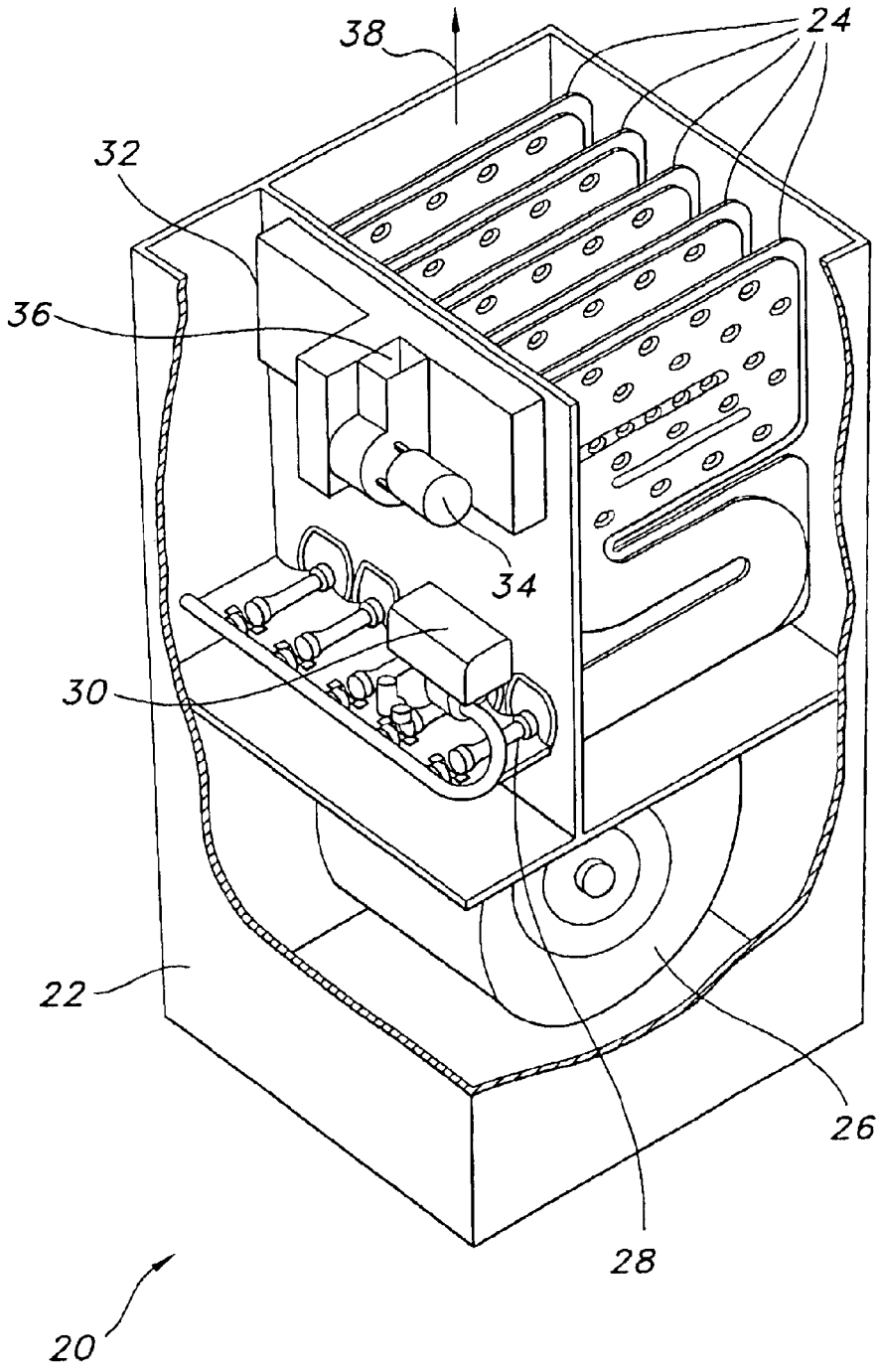
FIG. 2 (PRIOR ART)
FIG. 2 is a perspective view of a prior art hot air furnace, partly broken away to reveal internal details, the furnace incorporating a multiple burner unit as schematically illustrated in FIG. 1.
Figure 3:
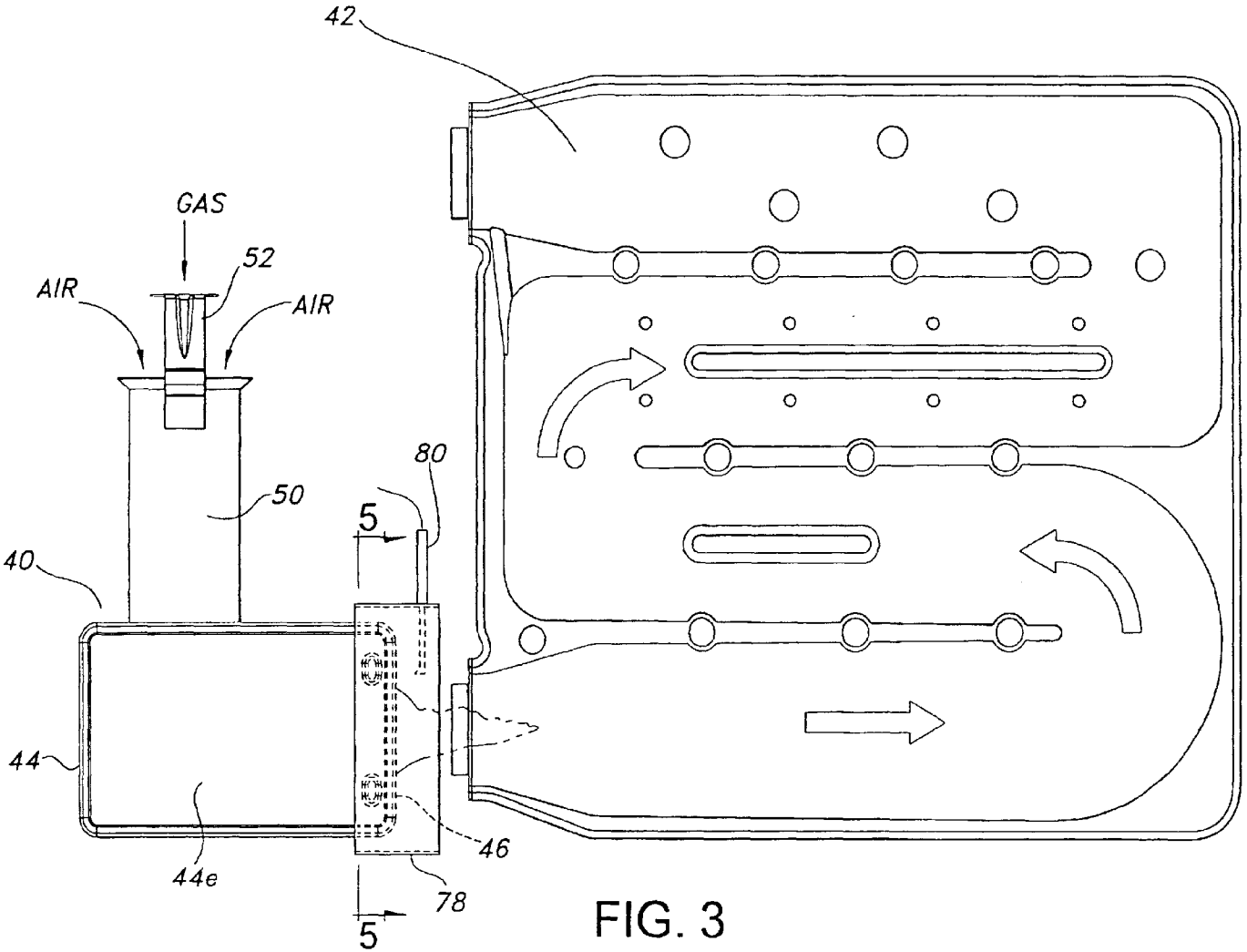
FIG. 3 is a side elevation view of a single burner in accordance with the present invention for use with a plurality of heat exchangers in a hot air furnace.
Figure 4:
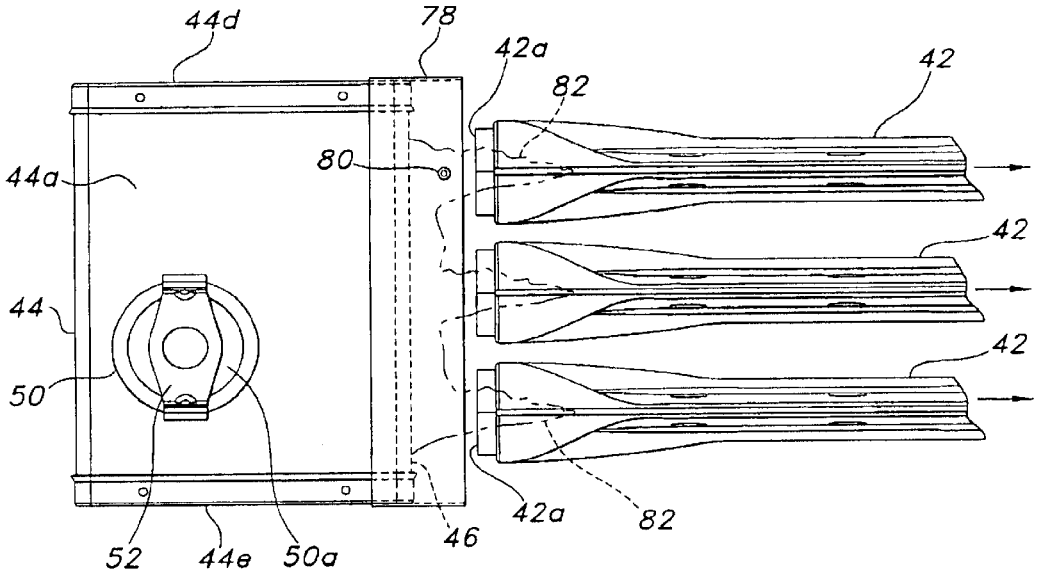
FIG. 4 is a top plan view of the single burner, plural heat exchanger system of FIG. 3.
Figure 5:
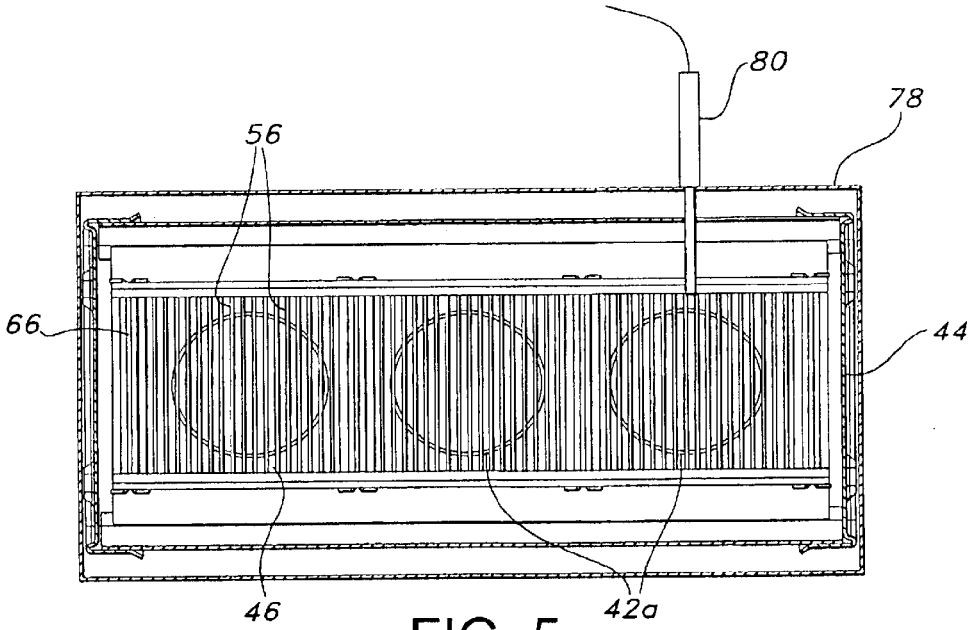
FIG. 5 is a cross-sectional view of the single burner plural heat exchanger arrangement of FIG. 4 as seen along viewing lines V—V.

Turning now to the drawings, there is shown in FIGS. 3, 4 and 5 a single burner 40 for use with a plurality of heat exchangers 42. The single burner 40 in combination with the multiple heat exchangers 42 may be used in a hot air furnace such as that described in U.S. Pat. No. 4,467,780 described herein with respect to FIG. 2, the function and operation of which is herein incorporated by reference. In a preferred arrangement, heat exchangers 42 are of the type more particularly described and illustrated in commonly-owned, copending patent application, U.S. Ser. No. 10/299,314, entitled "COMPACT HIGH EFFICIENCY CLAM SHELL HEAT EXCHANGER", filed on even date herewith, the disclosure of which is incorporated herein by reference in its entirety.

Figure 6:
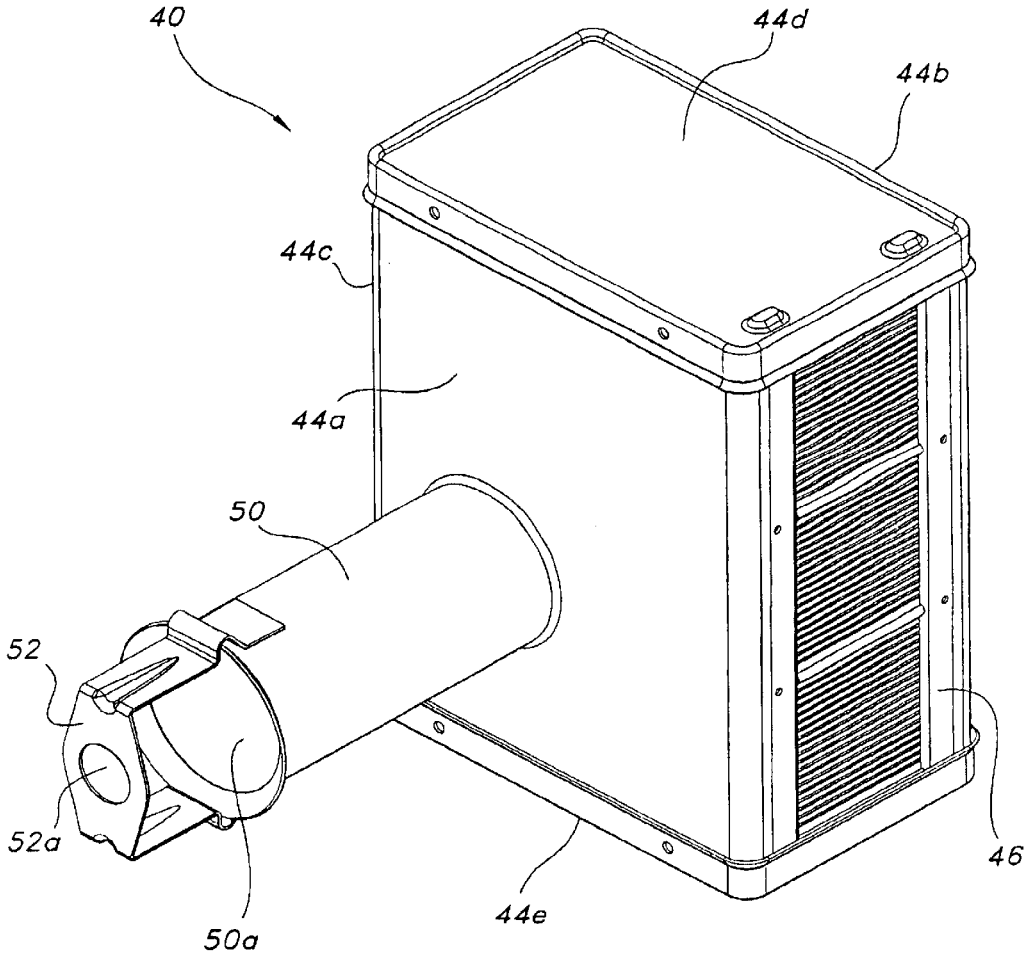
FIG. 6 is a top perspective view of the single burner of FIG. 3.
Figure 7:
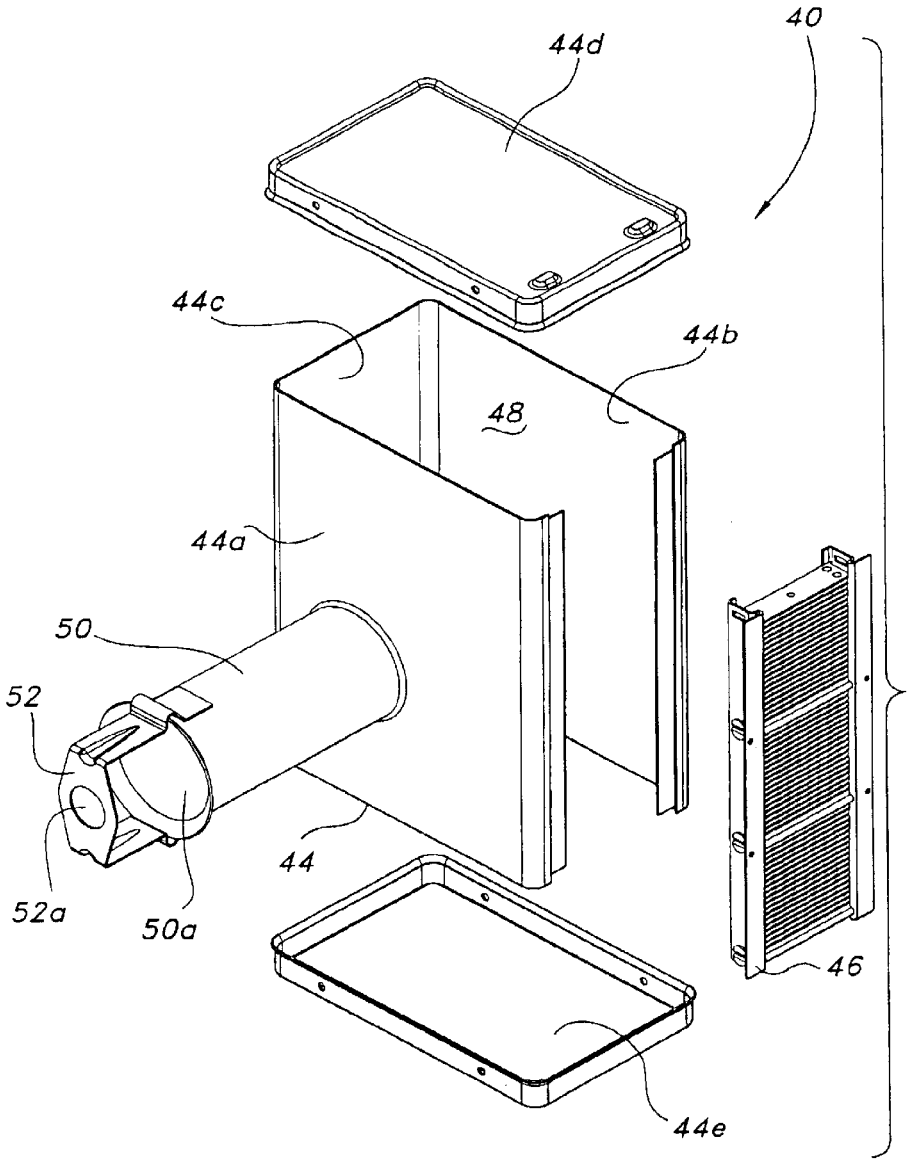
FIG. 7 is an exploded view of the single burner of FIG. 6.

Referring now also to FIGS. 6 and 7, further details of the single burner 40 are described. Burner 40 includes a housing 44 having an upper wall 44*a*, a lower wall 44*b*, a rear wall 44*c*, and two opposing sidewalls 44*d* and 44*e*. Burner face 46, the details of which will be described hereinbelow, defines the front wall of burner housing 44. Upper and lower walls 44*a* and 44*b*, rear wall 44*c* and burner face 46, and sidewalls 44*d* and 44*e* define a hollow mixing chamber 48 for air/gas mixture as will be described.

In the arrangement being described with respect to FIGS. 6 and 7, upper wall 44*a*, rear wall 44*c* and bottom wall 44*b* are formed from a single sheet of suitable material, such as cold-rolled steel, and are suitably folded as shown using conventional metalworking techniques. Sidewalls 44*d* and 44*e* are also formed of suitable material, such as cold-rolled steel, and are joined to the upper wall 44*a*, lower wall 44*b*, and rear wall 44*c* by suitable fasteners.

Attached to upper wall 44*a* of burner housing 44 and projecting outwardly therefrom is a venturi tube 50. The venturi tube 50 is, in one particular arrangement, of generally cylindrical configuration having an interior opening 50*a* communicating with mixing chamber 48 of burner housing 44. Attached to the free distal end of venturi tube 50 is a bracket 52 defining a gas orifice 52*a*. Suitably attached to bracket 52 (but not shown) is a gas valve for supplying gas into the venturi tube opening 50*a*. Air is also drawn into the venturi tube opening 50*a* for flowing into housing chamber 48 and mixing with the supplied gas, as depicted in FIG. 3. While the supplied gas in the arrangement being described is natural gas, it should be understood that other fuels, such as propane gas, may be used with the burner of the subject invention.

Figure 8:
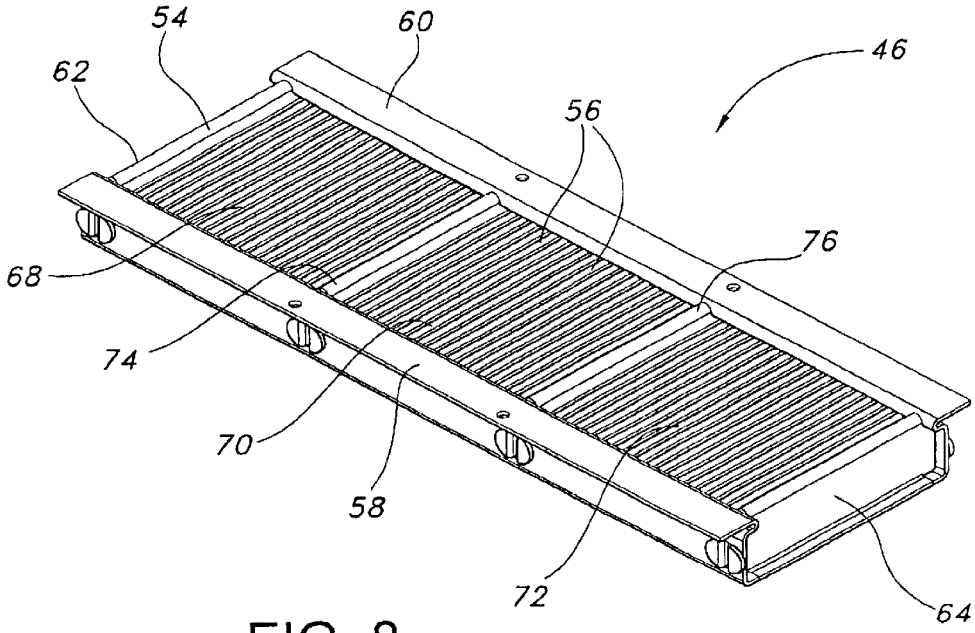
FIG. 8 is a perspective view of a ribbon tray defining a burner face of the single burner of FIG. 6.
Figure 9:
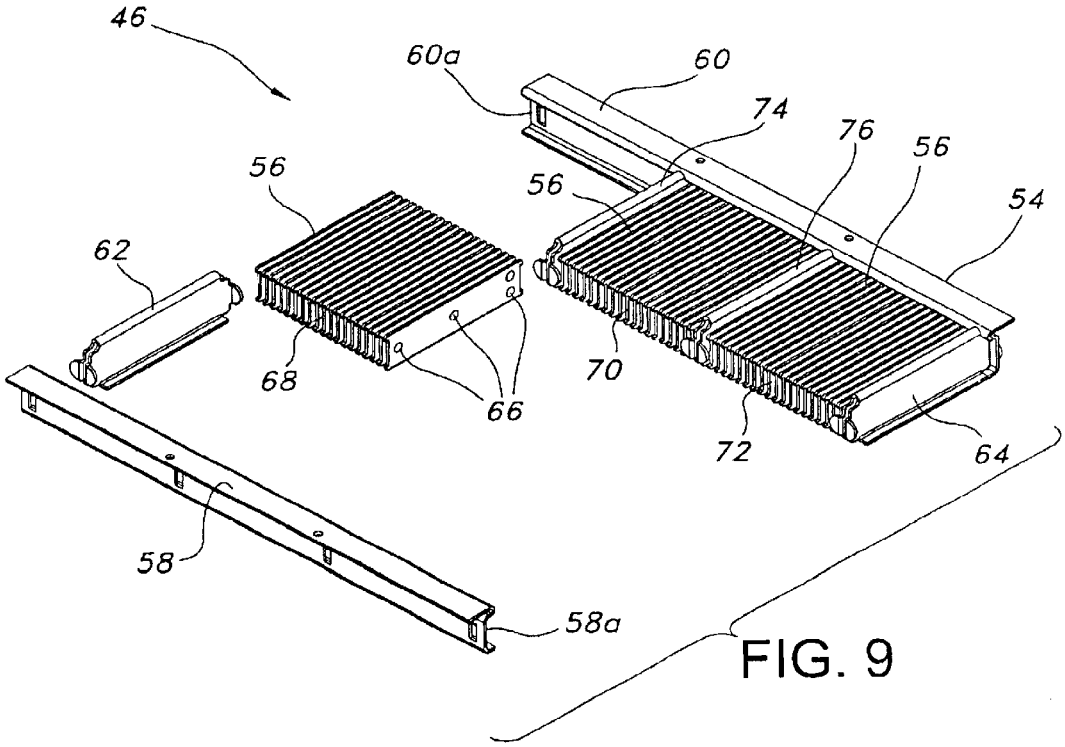
FIG. 9 is an exploded view of the burner tray of FIG. 8 showing details of the burner ribbons of the burner face.

Turning now also to FIGS. 8 and 9, the details of the burner face 46 are described. The burner face 46 includes a ribbon tray 54 having a plurality of spaced fins 56 supported by a pair of opposing side brackets 58 and 60 and end brackets 62 and 64. Fins 56 are formed preferably in ribbon fashion, whereby a continuous strip of suitable metal, such as steel, is folded back and forth upon itself to define the series of spaced fins 56. Maintenance of desired spacing between successive fins 56 is provided by one or more bosses 66 formed on the planar surfaces of the fins 56, the bosses being formed to project at a selected height to form the desired spacing between successive fins 56. While spaced fins 56 are preferably formed, as described, in ribbon fashion, it should be understood that a plurality of individual fins may also be used in the burner face 46.

In the particular arrangement of the ribbon tray 54 as shown in detail in FIG. 9, the plurality of spaced fins 56 are preferably arranged in three ribboned sections 68, 70 and 72. Intermediate lateral brackets 74 and 76 are provided to separate the ribboned sections. The ribboned sections 68, 70 and 72, together with end brackets 62 and 64 and intermediate brackets 74 and 76, are supported within channels 58*a* and 60*a* on respective side brackets 58 and 60.

Referring again to FIGS. 3, 4 and 5, the operation of the single burner in a gas-fired furnace is described. A support frame 78 is suitably secured to the burner housing 44 adjacent the burner face 46. The support frame is suitably secured to the furnace (not shown) such that the burner face 46 faces and is located adjacent to the clamshell heat exchangers 42. The support frame 78 also functions as a secondary air shield around the single burner 40. Supported by support bracket 78 at a location between burner face 46 and the inlet ports 42*a* of each of the heat exchangers 42 is an igniter 80. Igniter 80 is suitably wired to provide an electrical spark for igniting the air/gas mixture flowing through the fins 56 of burner face 46, as will be described.

In operation, gas, such as natural gas, is supplied into the venturi tube 50 where a quantity of air is also introduced. The supplied gas and introduced air are drawn into the burner mixing chamber 48 as a result of the suction pressure produced by an induction draft fan 36 which is connected to the exhaust ports of the heat exchangers 42. The air/gas mixture drawn through the burner face 46 is ignited by igniter 80 causing combustion of the air/gas mixture. As a result of the negative pressure in each heat exchanger 42, a flame 82 forms in each heat exchanger through inlet port 42*a*. The relatively narrow passages between the spaced fins 56 of the ribbon tray 54 at the burner face 46 cause an increase in the velocity of the air/gas mixture as well as enhanced stability of the air/gas mixture flowing therethrough. The flow passages between the spaced fins 56 also contribute to resistance to flame flashback. In particular, the mass; spacing and depth of the spaced fins 56 act together to lower the flame velocity to match the velocity of the unburned air-gas mixture passing through the spaced fins 56. An air-gas mixture that is too high will cause the flame to "lift" and burn in front of the spaced fins 56. An air-gas mixture that is too low will result in the flame "flashing" through the spaced fins 56. A proper air-gas velocity allows the flame to burn at the outside front edge of the spaced fins 56 in the burner 40. The spacing between fins 56, which is also a factor in controlling the resistance of the burner to flame flashback, may be adjusted by varying the height of the bosses 66 between fins. Furthermore, the spaced fins 56, particularly in the ribboned arrangement, are free to expand and contract during the heating and cooling cycles so as to reduce the mechanical stress occurring during operation of the burner, and to thereby provide longer operating life.

It should now be appreciated that the single burner arrangement, as described herein, provides significant advantages over the conventional multiple burner configurations. For example, cost savings may be realized as a result of the elimination of the gas manifold used in the multiple burner arrangement as well as a reduction in the number of independent burners. In addition, the single burner replaces multiple orifices with a single orifice that more effectively meters the proper amount of combustible air/gas mixture flowing through the burner face.

Having described the preferred embodiments herein, it should now be appreciated that variations may be made thereto without departing from the contemplated scope of the invention. Accordingly, the preferred embodiments described herein are deemed illustrative rather than limiting, the true scope of the invention being set forth in the claims appended hereto.

What is claimed is:

1. A single burner, heat exchanger combination for a fuel-fired furnace, comprising:

a plurality of spaced heat exchangers, each heat exchanger having an inlet port for receipt therein of combustion gases; and a unitary burner for producing combustion gases, said burner having a continuous burner face for passing therethrough a combustible gas and a mixing chamber for receipt therein of combustible gas, said mixing chamber communicating with said burner face, said burner face being defined by a plurality of spaced apart fins, said fins extending continually along said burner face, aid inlet ports of each heat exchanger being disposed adjacent to and in fluid communication with said burner face, whereby combustion gases may flow from between the fins of said burner face and into each of the inlet ports of said heat exchangers.

2. The combination of claim 1, wherein said burner comprises spaced walls defining said mixing chamber.

3. The combination of claim 2, wherein said burner comprises a venturi tube supported by one of said walls, said venturi tube having an interior opening communicating with said mixing chamber.

4. The combination of claim 1, wherein said fins are spaced by one or more bosses disposed on selected fins, the height of said bosses being selected to provide desired fin spacing.

5. The combination of claim 4, wherein said fins are defined by a single continuous strip of material formed in ribbon fashion.

6. The combination of claim 5, wherein said fins are arranged in separate sections of ribboned fins.

* * * * *

UNITED STATES PATENT AND TRADEMARK OFFICE

CERTIFICATE OF CORRECTION

PATENT NO. : 6,889,686 B2
APPLICATION NO. : 10/299479
DATED : May 10, 2005
INVENTOR(S) : Werner Specht It is certified that error appears in the above-identified patent and that said Letters Patent is hereby corrected as shown below:

At column 6, line 4, reads "...face, aid inlet ports…"; the patent should read --...face, said inlet ports…--.

Signed and Sealed this

Twenty-third Day of September, 2008

JON W. DUDAS
*Director of the United States Patent and Trademark Office*